US005184533A

United States Patent [19]

Golicz

[11] Patent Number: 5,184,533

[45] Date of Patent: Feb. 9, 1993

[54] METHODS AND APPARATUS FOR CUTTING SHEETS FROM A WEB

[75] Inventor: Roman M. Golicz, Clinton, Conn.

[73] Assignee: Pitney Bowes Inc., Stamford, Conn.

[21] Appl. No.: 576,766

[22] Filed: Sep. 4, 1990

[51] Int. Cl.[5] ..... B26D 7/18; B26D 1/46

[52] U.S. Cl. ..... 83/24; 83/53; 83/100; 83/177; 83/236; 83/803

[58] Field of Search ..... 83/22, 24, 100, 402, 83/788, 792, 803, 42, 53, 56, 177, 236, 431

[56] References Cited

U.S. PATENT DOCUMENTS

| | | | |
|---|---|---|---|
| 2,114,415 | 4/1938 | Campbell | 83/169 |
| 2,628,644 | 2/1953 | Elbon | 83/792 |
| 3,301,114 | 1/1967 | Joa | 83/236 |
| 3,345,894 | 10/1967 | Carlson et al. | 83/100 |
| 3,589,221 | 6/1971 | Deegan | 83/42 X |
| 3,757,619 | 9/1973 | Gianese | 83/402 X |
| 3,876,324 | 4/1975 | Ballard | 83/53 X |
| 4,249,438 | 2/1981 | Kelley | 83/53 |
| 4,308,774 | 1/1982 | Bohler et al. | 83/100 |
| 4,364,552 | 12/1982 | Besemann | 83/88 X |
| 4,429,602 | 2/1984 | Vits | 83/24 |
| 4,593,893 | 6/1986 | Suter | 270/52.5 |
| 4,680,083 | 7/1987 | Kashiwaba | 83/511 X |
| 4,799,997 | 1/1989 | Thompson | 83/511 X |

FOREIGN PATENT DOCUMENTS

| | | | |
|---|---|---|---|
| 16574 | 7/1907 | Norway | 83/803 |

*Primary Examiner*—Eugenia Jones

*Attorney, Agent, or Firm*—Donald P. Walker; Melvin J. Scolnick

[57] ABSTRACT

Apparatus for processing an elongate web of sheets is provided, which includes structure for continuously feeding successive sheets of the web in a path of travel, structure for successively cutting the successive sheets from the web, and structure for successively deflecting the successive sheets out of the path of travel and into cutting relationship with the cutting structure.

30 Claims, 4 Drawing Sheets

METHODS AND APPARATUS FOR CUTTING SHEETS FROM A WEB

BACKGROUND OF THE INVENTION

This invention is generally concerned with sheet feeding and cutting apparatus and more particularly with methods and apparatus for cutting sheets from a continuously moving web thereof.

In U.S. Pat. No. 4,593,893 for A Method And Apparatus For Sequentially Advancing and Cutting Forms From Two Continuous Form-Webs, issued Jun. 10, 1986 to Walter Suter, there is described structure for feeding a web of sheets in a downstream path of travel between opposed knife cutters, extending transverse to the path of travel, for cutting respective sheets from the web. Due to such cutters typically having a cutting cycle of from 80 to 100 milliseconds, if a typical web feeding speed of 100 inches per second is assumed, then, 8 to 10 inches of the length of the web would be jammed against the cutters during each cutting cycle if web feeding was not stopped during the cutting cycle. As a result, the throughput rate of feeding the web to and through the cutting structure is reduced by the lapsed time interval needed to temporarily stop the web for cutting each sheet therefrom.

In U.S. Pat. No. 4,014,535 for a Continuous Sheet Collating Method and Apparatus, issued Mar. 19, 1977 to Robert E. Kleid et al., there is described structure for continuously feeding a web of sheets in a downstream path of travel between opposed rotary sheet feeding drums, one of which is a collating drum and the other of which is equipped with a cutter that extends transverse to the path of travel. Although this patent is primarily concerned with the disclosure of collation structure, it also discloses typical rotary web cutting structure including a rotary cutting drum having a circumference which is equal to the length of the sheets cut from the web. And illustrates the fact that the physical dimensions of the cutting drum must be made proportional to the length of sheets which are to be cut from a given web, since different lengths of sheets, which are not equal to or a multiple of the circumferential length of the cutting drum, could not be cut from the web without stopping operation of the equipment and changing the cutting drum.

In U.S. Pat. No. 2,114,415, for an Art Of Manufacturing Folded Paper Articles, issued Apr. 19, 1938 to Samuel J. Campbell, there is described structure for continuously feeding a fan-folded web in a downstream path of travel and into engagement with a transversely extending band-blade cutter, which has a cutting belt run which extends parallel to and is located midway between the opposed fold edges of the web for cutting two folded sheets at a time from the web. Although this Patent exemplifies usage of a band blade cutter for cutting sheets from a continuous web like the rotary cutting structure of the above discussed Kleid et al. patent the physical dimensions of the equipment, in this instance the fan folding structure, would have to be changed to cut sheets of different or varying dimensions from a web.

Accordingly:

An object of the invention is to provide improved web feeding and cutting apparatus;

Another object is to provide improved methods and apparatus for cutting sheets of different or varying lengths from a web thereof; and Another object is to provide high speed web feeding and cutting apparatus, including structure for cutting respective sheets from the web as the web is continuously moving.

SUMMARY OF THE INVENTION

Apparatus for processing an elongate web of sheets, comprising: means for continuously feeding successive sheets of said web in a path of travel; means for successively cutting said successive sheets from said web; and means for successively deflecting said successive sheets out of said path of travel and into cutting relationship with said cutting means.

BRIEF DESCRIPTION OF THE DRAWINGS

As shown in the drawings wherein like reference numerals designate like or corresponding parts throughout the several views.

DESCRIPTION OF THE PREFERRED EMBODIMENTS

Figure 1:
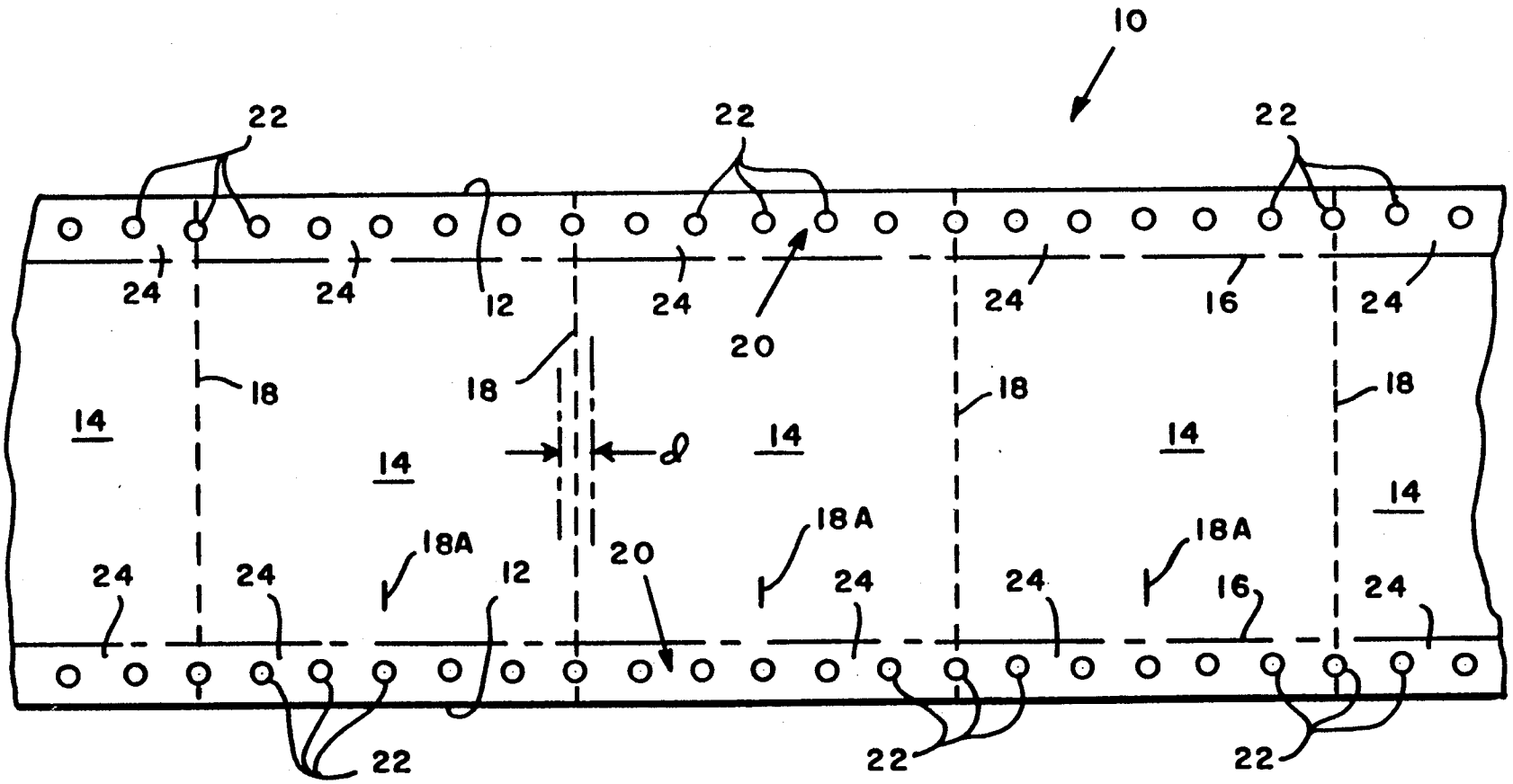
FIG. 1 is a plan view of a typical web of sheets.

As shown in FIG. 1, an elongate web 10, of the type which may be processed in accordance with the invention, generally comprises an elongate web of paper having opposed, longitudinally-extending, side edges 12. The web 10 includes a plurality of successive, uniformly dimensioned, sheets 14. For discussion purposes, the sheets 14 are shown to be serially defined in the web 10 by means of a pair of parallel-spaced, longitudinally-extending, dashed lines 16, which are conventionally marked thereon, and by means of a plurality of parallel-spaced, transversely-extending, perforate lines 18, which are conventionally formed in the web 10 at equal intervals longitudinally of the length thereof. The side edges 12 and dashed lines 16 additionally define a pair of parallel-spaced marginal edges 20, each of which has a plurality of sprocket holes 22 which are formed therein at equidistantly spaced intervals longitudinally of its length. And, each adjacent pair of the transverse perforate lines 18 defines a pair of opposed portions 24 of the marginal edges 20 which border the sheet 14 between such lines 18.

Notwithstanding the foregoing, it is noted that the marked lines 16 (FIG. 1) are not typically provided. Moreover, without departing from the spirit and scope of the invention, rather than perforate lines 18, the lines 18 may be marked on the web 10, or, rather than providing any lines 18, each of the sheets 10 may have a mark 18A thereon which is located a predetermined known distance from an imaginary cut line 18. Moreover, the sheets 14 need not be uniformly dimensioned for practicing the invention, rather, any adjacent pair of parallel or cut lines 18 may be spaced from one another any given distance. Still further, the web 10 need not include the opposed longitudinally-extending marginal edges 20.

Figure 2:
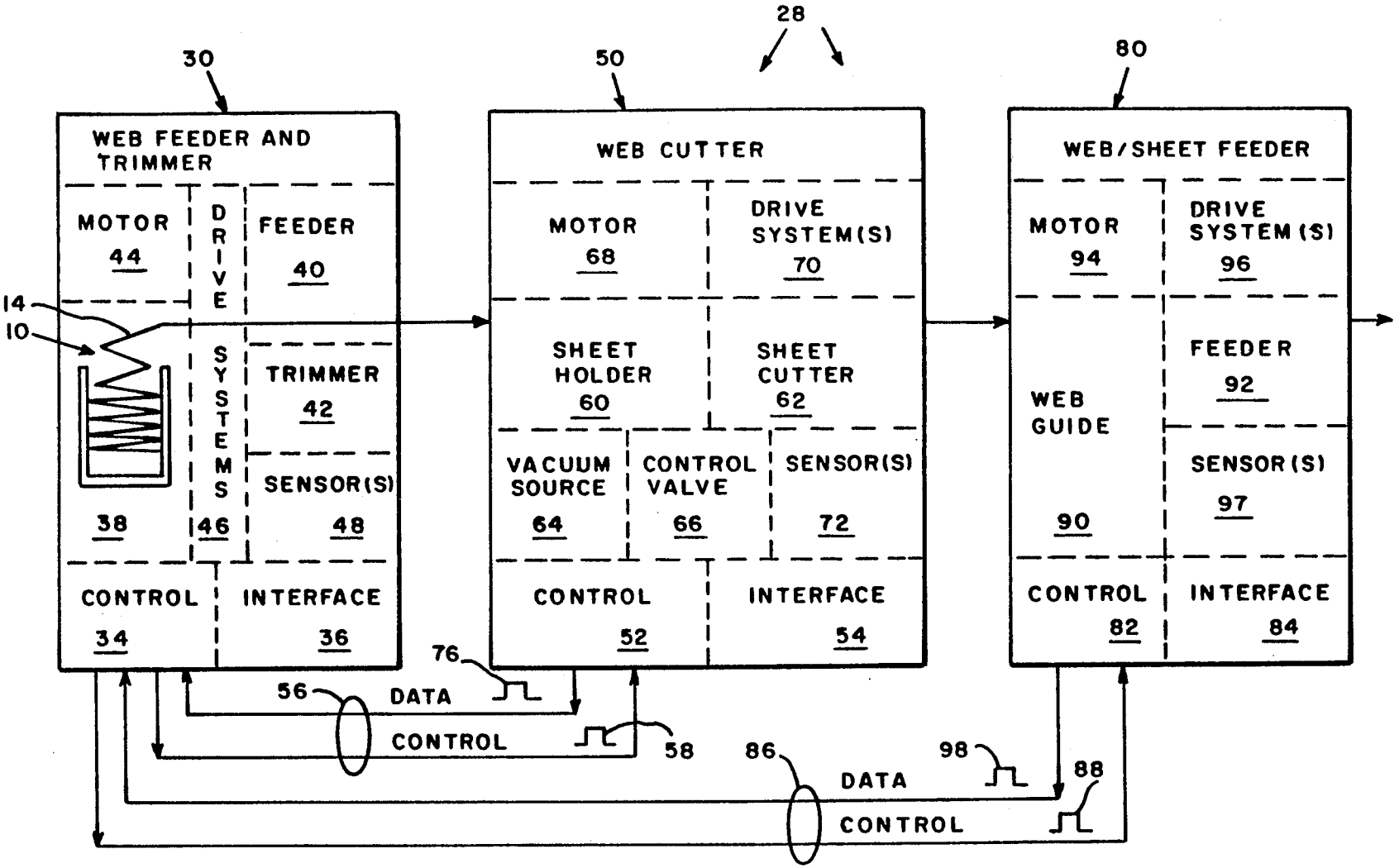
FIG. 2 is a block diagram of apparatus according to the invention.

As shown in FIG. 2, according to the invention, the apparatus 28 generally comprises a conventional web feeding and trimming assembly, or module, 30. The module 30 includes suitable control structure 34, such as a microprocessor, for controlling the various structures and functions of the module 30. In addition, the module 30 includes a conventional operator interface 36, such as a keyboard which is conventionally coupled to the control structure 34 for operation thereof in response to input signals from the keyboard 36.

In general, the web feeding and trimming assembly, or module, 30 (FIG. 2) additionally includes conventional web supplying structure 38 for supporting a fan-folded web 10 of sheets 14, or, alternatively, may include a conventional spool of a continuous web 10 from which sheets 14 of any given length may be cut. In addition, the module 30 includes conventional feeding structure 40. The feeding structure 40 is preferably a conventional tractor drive-type web feeder, but may be any other type of feeder, including for example roller-type structure for engaging and feeding the web 10 from a spool. And the module 30 may also include conventional web trimming structure 42, such as suitable cutters, for separating the opposed marginal edges 20 (FIG. 1) of the web 10 therefrom. Further, the module 30 (FIG. 2) includes a motor 44 and one or more drive systems 46 for the feeding structure 40. The module 30 may also include one or more conventional sensing structure(s) 48 for sensing respective marks or lines, 18 or 18A, and sensing respective positions of selected elements of the drive systems 46 including their respective home positions. The sensing structure(s) 48 are conventionally coupled to the control structure 34 for providing suitable input signals thereto for operation of the structures of the web feeding and trimming assembly or module 30.

According to the invention, the apparatus 28 (FIG. 2) additionally generally comprises a web cutting assembly, or module, 50, including suitable control structure 52, such as a microprocessor, for controlling the various structures and functions of the module 50. Although the module 50 may include a conventional operator interface 54, such as a keyboard which is conventionally coupled to the control structure 52 for operation thereof in response to input signals from keyboard, the module 50 may alternatively include a two-way serial or parallel communication link 56 conventionally coupling the control structure 52 to the web feeding and trimming module's control structure 34, for operation of the control structure 52 in response to control signals, such as the signal 58, received from the control structure 34.

In general, the sheet cutting assembly, or module, 50 (FIG. 2), additionally comprises sheet holding structure 60, sheet cutting structure 62, a conventional vacuum source and a control valve therefor 66, a motor 68 and one or more drive systems 70 for the cutting structure 60. Still further, the module 50 may include one or more sensing structures 72 for sensing positions of one or more elements of the drive systems 70 and providing digital signals, such as the signal 76, to the web feeding and trimming module 30 corresponding to respective positions of such elements.

According to the invention, the apparatus 28 (FIG. 2) also generally comprises a web and sheet feeding assembly, or module, 80, including suitable control structure 82, such as a microprocessor, for controlling the various structures and functions of the module 80. Although the module 80 may include a conventional operator interface 84, such as a keyboard which is conventionally coupled to the control structure 82 for operation thereof in response to input signals from the keyboard, the module 80 may alternatively include a two-way serial or parallel communication link 86 conventionally coupling the control structure 82 to the web feeding and trimming module's control structure 54, for operation of the web and sheet feeding module 80 in response to control signals, such as the signal 88, received from the control structure 34.

In general, the web and sheet feeding assembly, or module, 80 (FIG. 2), additionally comprises web guiding structure 90, web and sheet feeding structure 92, a motor 94, and a drive system 96 for the feeding structure 92. Still further, the module 80 may include one or more sensing structures 97 for sensing positions of one or more elements of the drive system 96 and providing digital signals, such as the signal 98 to the web feeding and trimming module 30 which correspond to respective positions of such elements and thus of the feeding structure 92.

Figure 3:
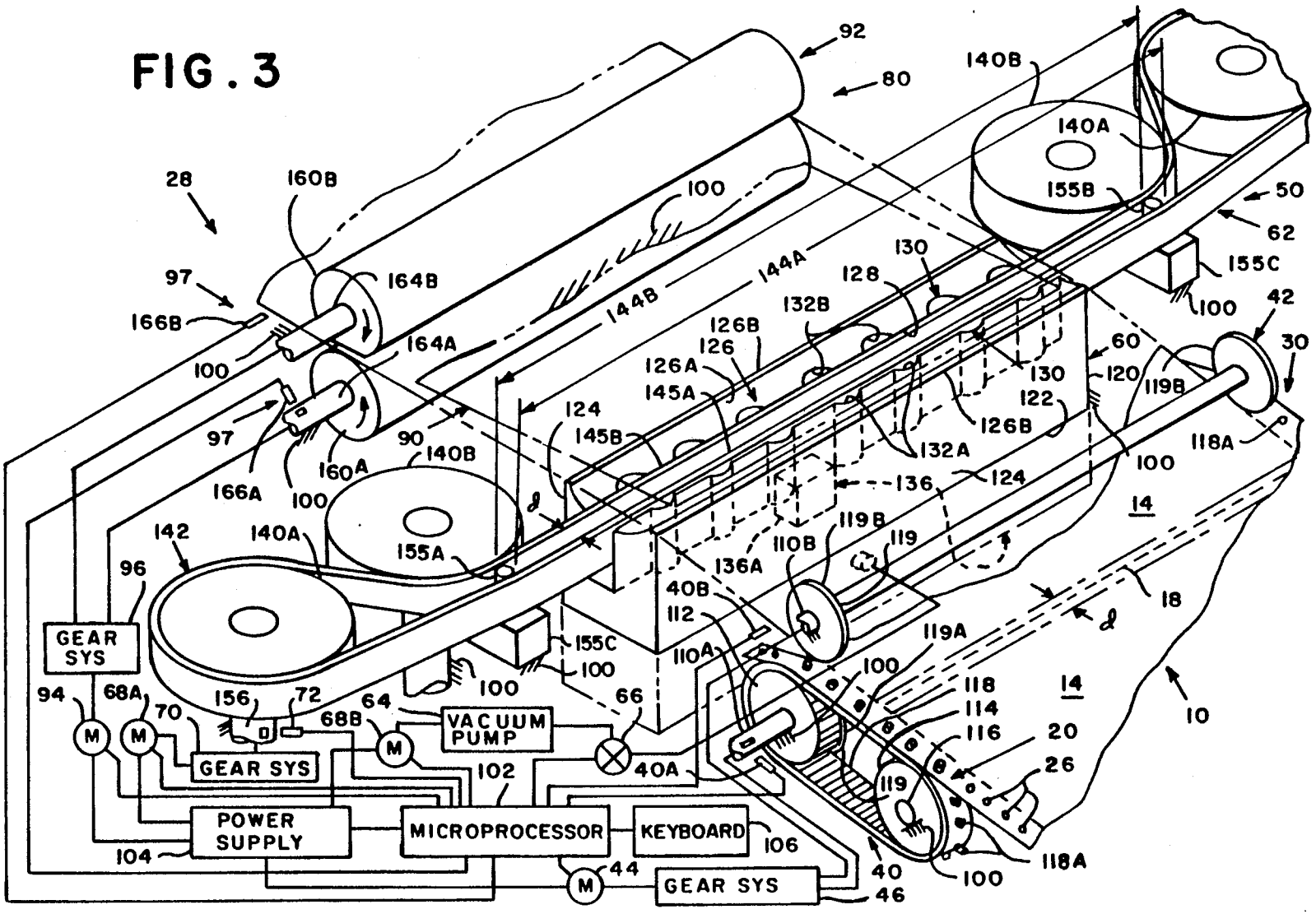
FIG. 3 is a partially schematic perspective view of the apparatus according to the invention, including details of the sheet cutting and the web and sheet feeding structures.

As shown in FIG. 3, in the preferred embodiment, the apparatus 28 includes a conventional frame 100 for supporting a web feeding and trimming assembly 30, web cutting assembly 50 and web and sheet feeding assembly 80. Moreover, the apparatus 28 includes a conventional microprocessor 102, and a suitable power supply 104. The microprocessor 102 preferably includes the control structures 34, 52 and 82 (FIG. 2) of the assemblies 30, 50 and 80. And, the apparatus 28 (FIG. 3) includes a suitable keyboard 106, conventionally connected to the microprocessor 102, which incorporates the structures and functions of the assembly interfaces 36, 54 and 84, including the communications links 56 and 86.

In the preferred embodiment, the web feeding and trimming assembly 30 (FIG. 3) includes the motor 44, which is conventionally connected to the power supply 104 for energization thereby, to the microprocessor 102 for control thereof and to the drive system 46. And the drive system 46 comprises a conventional gear system including output drive shafts 110A and 110B. Further, the web feeding structure 40 preferably includes a conventional tractor drive including a first pair of timing pulley gears 112, one of which is shown in FIG. 3. The timing pulley gears 112 are spaced apart from one another and mounted on the output drive shaft 110A for rotation therewith. In addition, the web feeding structure 40 includes a second pair of timing pulley gears 114, one of which is shown, which are spaced apart from one another and mounted on an idler shaft 116 for rotation therewith. And, the idler shaft 116 is conventionally rotatably connected to the frame 100. Moreover, the web feeding structure 40 includes a pair of endless timing belts 118, one of which is shown, which are spaced apart from one another and respectively looped about one of each of the first and second timing pulley gears, 112 and 114, and disposed in meshing engagement therewith for transmitting drive from the first pair of timing pulley gears 112 to the second pair of timing pulley gears 114. And the timing belts 118 each include a plurality of protrusions 118A extending outwardly from the belt 118, at intervals longitudinally of the length of the belt 118 which correspond to the intervals between the sprocket holes 22 formed in the marginal edges 20 of the web 10.

In addition, in the preferred embodiment the assembly's web trimming structure 42 (FIG. 3) preferably includes two pairs of disc-shaped cutters 119 which are spaced apart from one another. One of cutters 119A, of each of the pairs of cutters 119, is conventionally connected to the drive shaft 110A for rotation thereby. And the other cutter 119B, of each of the pairs of cutters 119 is conventionally connected to a drive shaft 110B for rotation thereby. Moreover, the sensing structure 48 of the assembly 30 includes a first conventional sensor 40A which is suitably located in sensing relationship with the drive shaft 110A, and is conventionally connected to the microprocessor 102. The sensor 40A is preferably conventionally constructed and arranged for providing digital signals to the microprocessor 102 which correspond to successive angular positions of the shaft 110A during successive time intervals, for providing input to the microprocessor 102 corresponding to the angular velocity of the drive shaft 110A. Further, the assembly 30 includes a second conventional sensor 40B which is suitably located in sensing relationship with the web 10, and is conventionally connected to the microprocessor 102. The sensor 40B is preferably conventionally constructed and arranged for providing digital signals to the microprocessor 102 whenever respective marks or perforations, 18 or 18A, of the web 10 are sensed, for sensing the successive trailing and leading edges of successive sheets 14 of the web 10.

In the preferred embodiment the web cutting assembly 50 (FIG. 3) includes the sheet holding structure 60. The sheet holding structure 60 comprises an elongate, substantially solid rectangle-shaped, vacuum plenum block or manifold 120. The vacuum manifold 120 is conventionally connected to the frame 100 and has an elongate lower surface 122, elongate parallel-spaced side surfaces 124, and an elongate upper surface 126. The upper surface 126 preferably includes an elongate cavity 126A, formed therein from the upper surface 126, which extends longitudinally of the length of the surface 126. In addition, the upper surface 126 includes a pair of elongate parallel-spaced marginal edge portions 126B from which the cavity 126A extends inwardly of the vacuum manifold 120. Further, the vacuum manifold 120 includes an elongate rectangularly-shaped slot 128 formed downwardly into the vacuum manifold from the center of the cavity 126A, such that in transverse cross-section the cavity 126A is truncated. Still further, the vacuum manifold 120 includes two parallel-spaced rows, 130A and 130B, of a plurality of elongate apertures 132 which vertically extend downwardly alongside of the slot 128 and into the vacuum manifold 120 from the interior of the cavity 126A. Each of the apertures 132 is D-shaped in transverse cross-section. And the apertures 132 in each of the rows 130A and 130B are located at equidistantly spaced intervals longitudinally of the length of the slot 128 and thus of the cavity 126A and vacuum manifold 120. Moreover, the vacuum manifold 120 includes a vertically oriented vacuum plenum 136 which includes a portion 136A thereof which extends upwardly from the vacuum manifold's lower surface 122 and into air flow communication with the vacuum manifold's elongate slot 128 and thus into air flow communication with each of the D-shaped apertures 132 alongside of the slot 128, whereby the slot 128, apertures 132 and vacuum plenum 136 are in air flow communication with each other.

As shown in FIG. 3, the preferred embodiment of the sheet cutting structure comprises a band blade assembly 62, including a first pair of vertically axially oriented drums 140A, which are spaced apart from one another and conventionally rotatably connected to the frame 100, and a second pair of vertically axially oriented drums 140B, which are spaced apart from one another and conventionally rotatably connected to the frame 100 between the first pair of drums 140A. The band blade assembly 62 also includes a band blade 142 which is conventionally looped about the drums 140A, and disposed in driven engagement therewith, and is partially looped about each of the drums 140B in a manner such that the band blade 142 includes first and second opposed belt runs, 144A and 144B, which are located in parallel-spaced paths of travel extending longitudinally of the length of the vacuum manifold's elongate slot 128 and in overlapping relationship with the D-shaped apertures 132, and such that the cutting upper edges, 145A and 145B, of the belt runs, 144A and 144B, barely completely protrude into the manifold's surface cavity 126A below the level of the manifold's surface portions 126B for cutting a web portion urged into the cavity 126A. As thus constructed and arranged, the drums 140B guide the belt run 144B toward the belt run 144A. However, it is within the scope of the invention to dispense with the drums 140B. Whereupon the belt run 144B would not extend into and longitudinally of the length of the vacuum manifold's slot 128, but rather would extend parallel to the belt run 144A outside of the vacuum manifold 120 and, therefrom, outside of the manifold's cavity 126A to prevent utilization thereof for web cutting purposes.

Still further, in the preferred embodiment the sheet cutting structure 62 (FIG. 3) includes a pair of vertically oriented band blade guide posts, 155A and 155B, which are conventionally connected to the frame 100. The guide posts 155A and 155B are spaced apart from one another and located between the first and second band blade belt runs, 144A and 144B, for guiding the same into the aforesaid parallel-spaced paths of travel. Still further, for vertically supporting the respective belt runs, 144A and 144B, the sheet cutting structure 62 includes a pair of elongate blocks 155C, which are spaced apart from each other and conventionally connected to the frame 100 between the drums 140B. In addition, the sheet cutting structure 62 includes a motor 68A, which is conventionally connected to the power supply 104 and for energization thereof, to the microprocessor 102 for control thereof and to the drive system 70. And the drive system 70 comprises a conventional gear system including a drive shaft 156 for driving one of the band blade drums 140A.

In the preferred embodiment, the cutting assembly 50 (FIG. 3) also includes a second motor 68B, which is conventionally connected to the power supply 104 for energization thereof, to the microprocessor 102 for control thereof and to the vacuum source 64. And the vacuum source 64 comprises a conventional vacuum pump driven by the motor 68B. Moreover, in the preferred embodiment the control valve 66 (FIG. 2) preferably comprises a conventional, solenoid operable, air control valve 66. The valve 66 is conventionally connected in air flow communication between the vacuum plenum 136 and vacuum pump 64. And, for controlling the flow of air between the vacuum pump 64 and the vacuum plenum 136, via the air control valve 66, the solenoid of the valve 66 is connected to the microprocessor 102. Moreover, in the preferred embodiment, the sensing structure 72 (FIG. 2) preferably comprises a conventional sensor 72 (FIG. 3) which is suitably connected in sensing relationship with the band blade drive shaft 156, for providing digital signals to the microprocessor 102 which correspond to the position of the shaft 156 at respective time intervals, and thus to the angular velocity of the shaft 156 and the corresponding linear velocity of the respective band blade belt runs, 144A and 144B.

In the preferred embodiment the sheet and web feeding assembly 80 (FIG. 3) includes the feeding structure 92, which preferably comprises a pair of opposed, elongate, lower and upper rollers 160A and 160B. The roller 160A and 160B are conventionally rotatably connected to the frame 100 so as to axially extend parallel to each other and transverse to the path of travel of the web 10. Preferably, the upper roller 160B is D-shaped in transverse cross-section. In addition, the assembly 80 includes the guide structure which preferably comprises a generally rectangularly-shaped guide member 90 which is conventionally connected to the frame 100 so as to be disposed in overhanging relationship with respect to the band blade belt runs, 144A and 144B, and to extend downstream therefrom toward the rollers, 160A and 160B, for guiding the web 10 between the rollers, 160A and 160B. In addition, the assembly 80 includes the motor 94 and drive system 96. The motor 94 is conventionally connected between the power supply 104 and drive system 96. And the drive system 96 preferably comprises a conventional gear system including a drive shafts, 164A and 164B, connected for driving the respective roller, 160A and 160B. Further, the assembly 80 includes the sensing structure 97, which preferably includes a first sensor 166A which is conventionally connected in the microprocessor 102 and in sensing relationship with the drive shaft 164A for providing digital signals to the microprocessor 102 which correspond to the position of the shaft 164A at respective time intervals, and thus to the position and angular velocity of the rollers, 160A and 160B. Moreover, the sensing structure 97 includes a second sensor 166B, which is conventionally connected to the microprocessor 102 and in sensing relationship with respective sheets 14 of the web 10, for sensing the leading edge thereof.

Figure 4:
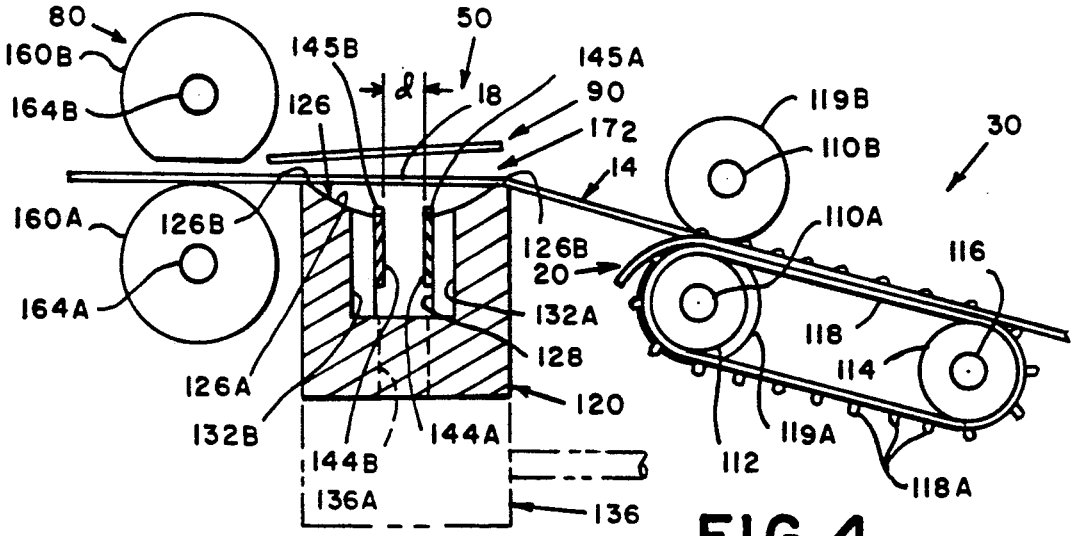
FIG. 4 is a schematic view of the apparatus according to the invention, showing the web prior to cutting a sheet therefrom.
Figure 5:
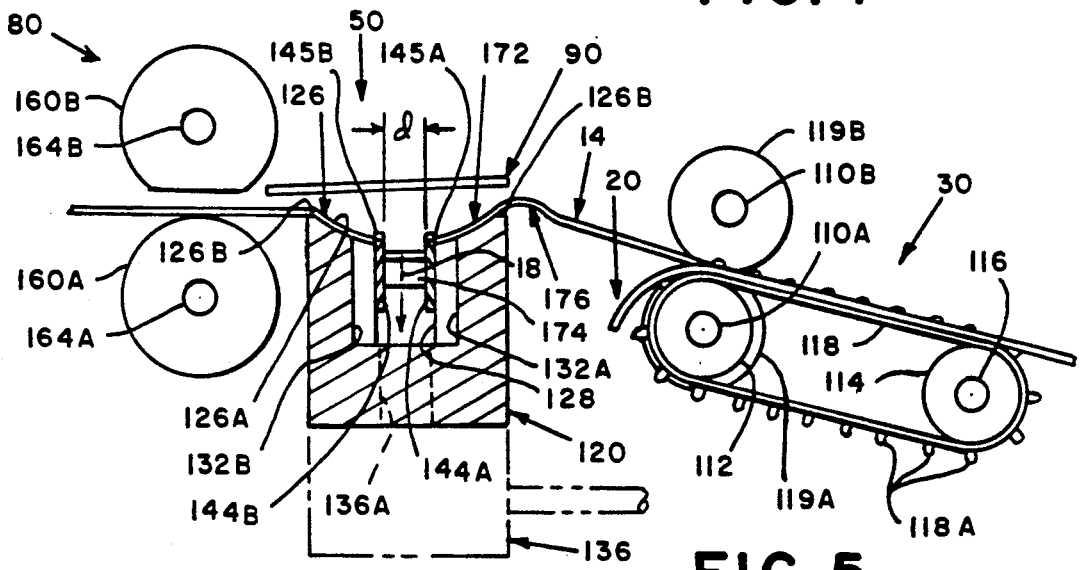
FIG. 5 is a schematic view, similar to FIG. 4, showing a sheet being cut from the web.
Figure 6:
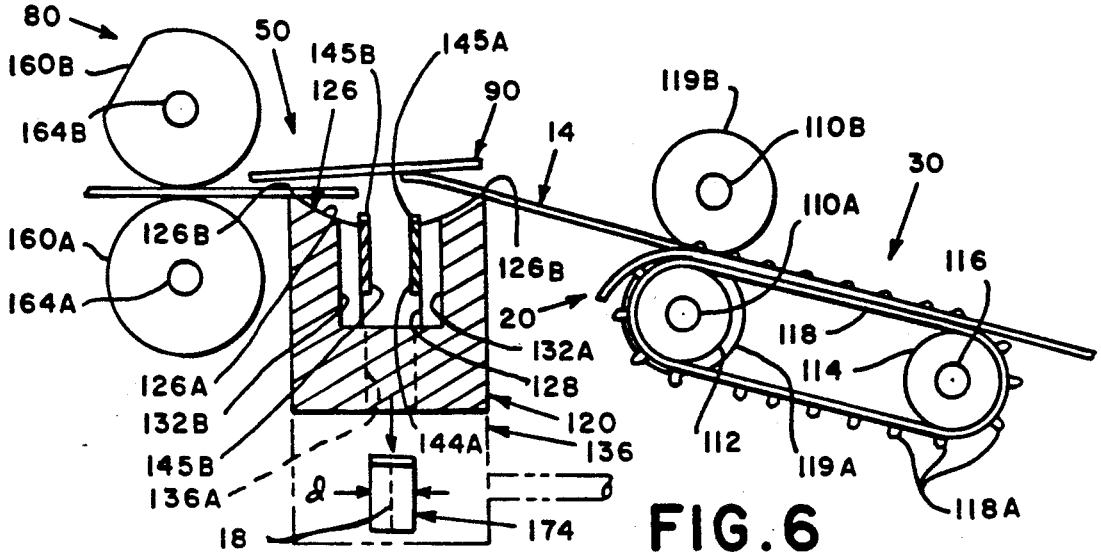
FIG. 6 is a schematic view, similar to FIG. 4, showing the cut sheet being fed from the web as the web is guided into feeding engagement with the web and sheet feeding rollers.

Operation of the apparatus 28 (FIG. 2) in accordance with the invention is portrayed in FIGS. 4–6. As shown in FIG. 3, the web 10 is assumed to include the opposed marginal edges 20 (FIG. 1), and thus the opposed marginal edge portions 24 bordering each sheet 14 of the web 10. As shown in FIGS. 3 and 4, the web feeding and trimming assembly 30 and web and sheet feeding assembly 80, under the control of the microprocessor 102, continuously feed the web 10 in a predetermined downstream path of travel 170A from the assembly 30, over and in bearing engagement with the vacuum manifold's upper surface portions 126B and between the feed rollers 160A and 160B. As the web feeding and trimming assembly's timing belts 118 (FIG. 3) feed the web 10, the disc-shaped cutters 119 separate the opposed marginal edge portions 24, bordering each successive sheet 14, from the web 10. In the course of such feeding, the web feeding and trimming assembly's sensor 40A (FIG. 3) provides conventional digital input signals to the microprocessor 102 which correspond to the angular velocity of the timing gear drive shaft 110, and thus to the linear feeding speed of the web 10. And the sensor 40B provides conventional digital input signals to the microprocessor 102 at the time instant each web line or mark 18 (FIG. 1) or 18A is sensed by the sensor 40B (FIG. 3). Moreover, the microprocessor 102 is conventionally programmed for utilizing the aforesaid signals from sensors 40A and 40B for calculating a time instant at which an imaginary cut line or the web line 18 (FIG. 4) is located centrally of the web cutting assembly's vacuum manifold 120. In addition, the microprocessor 102 (FIG. 3) is conventionally programmed for causing operation of the solenoid of the vacuum control valve 66 for a predetermined time interval, of about 6 milliseconds, commencing substantially at the aforesaid time instant. Whereupon air is exhausted from the vacuum plenum 136 via the vacuum control valve 66. As a result of the difference in air pressure thereby created between the lower and upper surfaces of the portion 172 of the web 10 (FIG. 4) which overhangs the vacuum manifold's upper surface cavity 126A, the overhanging portion 172 is urged or deflected, as shown in FIG. 5, out of the aforesaid path of travel and into engaging relationship with the surface of the cavity 126A, and thus downwardly, transverse to the aforesaid path of travel, and into cutting engagement with cutting upper edges 145A and 145B of the band blade belt runs 144A and 144B. Whereupon an elongate, rectangularly-shaped, web portion 174, which may include a web line 18, is severed or cut from the web 10 and drawn downwardly into the vacuum plenum 136. In this connection it is noted that since the band blade belt runs 144A and 144B are driven in opposite paths of travel through the vacuum manifold's slot 128, the cutting upper edges 145A and 145B, exert substantially equal and opposite cutting forces on the web 10 as the web portion 174 is cut from the web 10. As shown in FIG. 3, the severed web portion 174 has a transverse dimension "d" which corresponds to the perpendicular distance "d" between the belt runs 144A and 144B. In addition, during the aforesaid time interval, i.e., when the vacuum control valve 66 is operated for evacuating the vacuum plenum 136, since the web portion 172 is held in place by the difference in air pressure thereacross, continued feeding of the web 10 by the web feeding and trimming assembly 30 causes a web portion 176, upstream of the manifold 120, to buckle and loop upwardly. However, since the predetermined time interval of plenum evacuation is about 6 milliseconds, and web cutting occurs during that time interval, the aforesaid predetermined time interval is ended substantially immediately upon completion of web cutting. As a result, the buckle-looped web portion 176 is acceptably small compared to the length of the respective sheets 14 of the web 10. In this connection it is noted that assuming a predetermined time interval, or cycle time interval, of from 6 to 8 milliseconds and a web feeding speed of 100 inches per second, the buckle-looped web portion 176 would be from 6 to 8 tenths of an inch in length. Thus, under the control of the microprocessor 102 (FIG. 3) the vacuum control valve 66 is intermittently operated for successive, predetermined, cycling time intervals which are each of sufficiently short duration to effectuate deflection of each successive sheet 14 into cutting relationship with the band blade cutter edges, 144A and 144B, while at the same time avoiding excessive buckling of the next successive sheet 1 4 of the web 10 as the web 10 is continuously fed in the downstream path of travel 170 from the web trimming assembly 30. At the end of each of the aforesaid time intervals, the control valve 66, under the control of the microprocessor 102, is operated to vent the vacuum plenum 136 to the atmosphere, thereby equalizing the air pressure across the web portion 172 engaging the vacuum manifold's cavity 126A, and permitting the web portion 174 to fall, under the influence of gravity to the bottom of the vacuum plenum 136. Under the control of the microprocessor 102, the web and sheet feeding assembly's rollers, 160A and 160B, thereupon feed the cut sheet 14 away from the web 10, as the buckle-looped web portion 176 of the next successive sheet 14 snaps upwardly and into sliding engagement with the lower surface of the guide member 90. In this connection it is noted that the microprocessor 102 is conventionally programmed to energize the motor 94 for a predetermined time interval, which is sufficient to cause the rollers 160A and 160B to feed the cut sheet 14 away from the web 10, but is insufficient to engage and feed the web 10. Moreover, the roller 160B is returned to the home position thereof shown in FIG. 3, to permit the web feeding structure 30 to feed the web 10 between and thus into feeding relationship with the rollers 160A and 160B. Accordingly, as the web 10 is thereafter fed by the web feeding and trimming assembly 30 toward the web and sheet feeding assembly 80, the next successive sheet 14 of the web 10 is guided by the guide member 90 between the web and sheet feeding assembly's rollers 160A and 160B.

As noted above, it is within the scope of the invention to provide for a single band blade belt run 144A to extend through the vacuum manifold's slot 128. In which instance, in the course of operation of the apparatus 10, a web portion 174 would not be cut from the web 10, but rather, each sheet 10 would be cut from the web utilizing a single belt run 144A.

In accordance with the objects of the invention there has been disclosed improved web feeding and cutting apparatus including methods and apparatus for cutting sheets of different or varying lengths from a web thereof as the web is continuously moving.

What is claimed is:

1. Apparatus for processing an elongate web of sheets, comprising:

(a) means for continuously feeding successive sheets of said web in a path of travel;

(b) means for successively cutting said successive sheets from said web, said cutting means including a continuously moving band blade, said band blade having parallel-spaced blade runs extending transverse to said path of travel;

(c) means for successively deflecting said successive sheets out of said path of travel and into cutting engagement by said band blade, and said deflecting means deflecting said successive sheets into cutting relationship with both of said blade runs, whereby said blade runs cut transversely-extending sections and thus said successive sheets from said web.

2. The apparatus according to claim 1, wherein said deflecting means includes a vacuum plenum, and said deflecting means including means for intermittently evacuating said plenum for successively deflecting said successive sheets.

3. The apparatus according to claim 2, including means for controlling said intermittent evacuating means to establish the length of said successive sheets which are to be cut from said web.

4. The apparatus according to claim 1, wherein said feeding means is a first feeding means, said apparatus including second means for feeding away from said web said successive sheets cut therefrom, and said first feeding means successively feeding said web into feeding relationship with said second feeding means as said successive sheets are fed away from said web.

5. The apparatus according to claim 4, wherein said second feeding means includes opposed rollers, one of said rollers having a D-shaped transverse cross-section and said apparatus including means for intermittently driving said rollers.

6. The apparatus according to claim 1 including means for stopping successive portions of said web from being fed, said stopping means including said deflecting means, and said stopping means including means for successively deflecting said portions and thus said successive sheets.

7. The apparatus according to claim 1, wherein said sheet feeding means is a first feeding means, and said apparatus including second means for feeding said sheets away from said web.

8. The apparatus according to claim 1, wherein said deflecting means includes vacuum means.

9. The apparatus according to claim 8, wherein said vacuum means includes a vacuum plenum and means for intermittently evacuating said plenum.

10. Apparatus for processing an elongate web of paper sheets, comprising:

(a) first feeding means for continuously feeding successive sheets of said web in a path of travel;

(b) means for successively cutting said successive sheets from said web, said cutting means including a band blade having parallel-spaced blade runs extending transverse to said path of travel;

(c) means for successively deflecting said successive sheets out of said path of travel and into cutting engagement by said cutting means, said deflecting means deflecting said successive sheets into cutting relationship with both of said blade runs for cutting successive transversely-extending sections and thus said successive sheets from said web; and (d) second feeding means for feeding away from said web said successive sheets cut therefrom, and said first feeding means feeding said web into feeding relationship with said second feeding means as said successive sheets are fed away from said web.

11. The apparatus according to claim 10, wherein said deflecting means includes a vacuum plenum, and said deflecting means including means for intermittently evacuating said plenum for successively deflecting said successive sheets.

12. The apparatus according to claim 11 including means for controlling said intermittent evacuating means to establish the length of said successive sheets which are to be cut from said web.

13. The apparatus according to claim 10, wherein said second feeding means includes opposed rollers, one of said rollers having a D-shaped transverse cross-section, and said apparatus including means for intermittently driving said rollers.

14. Apparatus for processing an elongate web comprising:

(a) means for continuously feeding said web in a path of travel;

(b) means for stopping a portion of said web from being fed in and deflecting said web out of said path of travel;

(c) means for cutting a sheet from said portion while said portion is stopped and deflected, said cutting means including a band blade having parallel-spaced blade runs extending transverse to said path of travel; and (d) said deflecting means deflecting said successive sheets into cutting relationship with both of said blade runs, whereby said blade runs cut a transversely-extending section and thus said sheet from said web.

15. The apparatus according to claim 14, wherein said feeding means is a first feeding means, and said apparatus including second means for feeding said sheet away from said web.

16. The apparatus according to claim 15, wherein said second feeding means includes rollers means.

17. The apparatus according to claim 16 including means for guiding said web into feeding relationship with said roller means.

18. The apparatus according to claim 16, wherein said roller means includes a D-shaped roller, and said second feeding means including means for intermittently driving said D-shaped roller.

19. The apparatus according to claim 14, wherein said deflecting means includes vacuum means.

20. The apparatus according to claim 14, wherein said web feeding means feeds said successive sheets from a fan-folded web of sheets.

21. A method of processing an elongate web, comprising:

(a) continuously feeding said web in a path of travel;

(b) stopping a portion of said web from being fed in and deflecting said web out of said path of travel; and (c) providing a band blade cutter including parallel spaced blade runs; and (d) causing said blade runs to cut a transversely-extending section and thus a sheet from said web while said web is stopped and deflected.

22. The method according to claim 21 including the step of:

(e) feeding said sheet from said web after step (d).

23. The method according to claim 22 including the steps of:

(f) providing roller means; and (g) utilizing said roller means for implementing step (e).

24. The method according to claim 23 including the steps of:

(h) guiding said web into feeding relationship with said roller means.

25. The method according to claim 24, wherein step (a) includes the step of feeding said successive sheets from a fan-folded web of sheets.

26. The method according to claim 21 including the steps of:

(e) providing vacuum means;

(f) utilizing said vacuum means for implementing step (b).

27. A method of processing sheets of a web thereof, comprising:

(a) continuously feeding a plurality of successive sheets of the web in a path of travel;

(b) providing band blade cutting means including a band blade having parallel-spaced blade runs extending transverse to said path of travel;

(c) cutting successive transversely-extending sections from said web for successively cutting each sheet from said web; and (d) step (c) including the step of successively deflecting each of said sheets out of said path of travel and into cutting engagement by said cutting means.

28. The method according to claim 27, wherein step (c) includes the step of successively deflecting a portion of each sheet in a direction extending transverse to said path of travel.

29. A method of processing paper sheets of a web thereof, comprising:

(a) providing first feeding means and causing said first feeding means to continuously feed a plurality of successive sheets of the web in a path of travel;

(b) providing band blade cutting means including a band blade having parallel spaced band blade runs, and causing said band blade means to continuously move said band blade runs in opposite directions extending transverse to said path of travel;

(c) successively deflecting said web and thus each of said sheets out of said path of travel and into engagement by said band blade runs for cutting successive sections from said web and thus successively cutting each deflected sheet from said web; and (d) providing second feeding means, and causing said second feeding means to feed each cut sheet away from said web as said first feeding means feeds said web in said path of travel to said second feeding means.

30. The method according to claim 28 including the step of guiding said web in said path of travel and into feeding relationship with said feeding means after each successive section and sheet is cut from said web.

* * * * *